United States Patent [19]

Bosshard

[11] 4,067,550

[45] Jan. 10, 1978

[54] MIXING DEVICE

[75] Inventor: Christian Bosshard, Aesch, Switzerland

[73] Assignee: Ciba-Geigy Corporation, Ardsley, N.Y.

[21] Appl. No.: 714,947

[22] Filed: Aug. 16, 1976

[30] Foreign Application Priority Data

Aug. 29, 1975 Switzerland ..... 11248/75
June 30, 1976 Switzerland ..... 8393/76

[51] Int. Cl.[2] ..... B01F 9/00
[52] U.S. Cl. ..... 366/228; 366/170
[58] Field of Search ..... 259/14, 21, 22, 23, 259/24, 30, 5, 6, 7, 8

[56] References Cited

U.S. PATENT DOCUMENTS 2,319,821 5/1943 McLean ..... 259/24
3,108,952 10/1963 Antz ..... 259/8 X
3,457,047 7/1969 Tokimatsu ..... 259/24 X

*Primary Examiner*—Edward J. McCarthy
*Attorney, Agent, or Firm*—Karl F. Jorda

[57] ABSTRACT

A mixing device for viscous ingredients having a motor-driven rotor with a hollow interior defining a surface which is inclined to the axis of rotation of the rotor. Ducts coaxial with the rotational axis of the rotor feed the ingredients into the hollow interior of the rotor where they are premixed by impinging on one or more rods fixed in the rotor perpendicular to the axis of rotation. As the rods rotate with the rotor the premixed ingredients are thrown against the interior surface of the rotor where they flow over the surface to provide further mixing, the thoroughly mixed ingredients being thrown off the edge of the rotor in the form of droplets. Instead of using rods, a conical portion may be provided under the ducts in the hollow interior of the rotor.

7 Claims, 10 Drawing Figures

MIXING DEVICE

FIELD OF INVENTION

This invention relates to a device for mixing two or more thick viscous ingredients, the device having a motor-driven rotor, the same having a coaxial and substantially funnel-shaped mixing surface, means being provided to apply the ingredients which it is required to mix with one another to that region of the mixing surface which is near the rotational axis.

PRIOR ART

In the mixing device disclosed in French Patent Application No. 2,249,713, the ingredients which are required to be mixed with one another are each applied separately to a separate plate rotating coaxially with the mixing surface the ingredients being guided from the plate in separate centrifuging planes to the mixing surface. Since the discrete ingredients are applied separately in axially staggered centrifuging planes, much of the distance through which the ingredients flow on the mixing surface is wasted so far as the mixing process is concerned.

SUMMARY OF INVENTION

It is an object of the invention to obviate these disadvantages by providing a mixing device which combines the discrete ingredients before or at least immediately upon the impingement of the ingredients on the mixing surface.

Since the discrete ingredients are combined either before or immediately upon their impingement on the mixing surface, there is some premixing, the ingredients then flow along the mixing surface as a result of centrifugal force to complete the mixing process. If the ingredients are not combined before impingement upon the mixing surface, it is important that they should be applied to the mixing surface as far as possible at the same level - i.e., along very closely adjacent planes perpendicular to the rotational axis of the mixing surface. Thus all the ingredients have a common flow path, a feature which provides for optimum mixing and allows the mixing surface of the rotor to be made quite small.

BRIEF DESCRIPTION OF DRAWINGS

Preferred embodiments of the invention will now be described with reference to the accompanying drawings wherein.

DETAILED DESCRIPTION OF PREFERRED EMBODIMENTS

Figure 1:
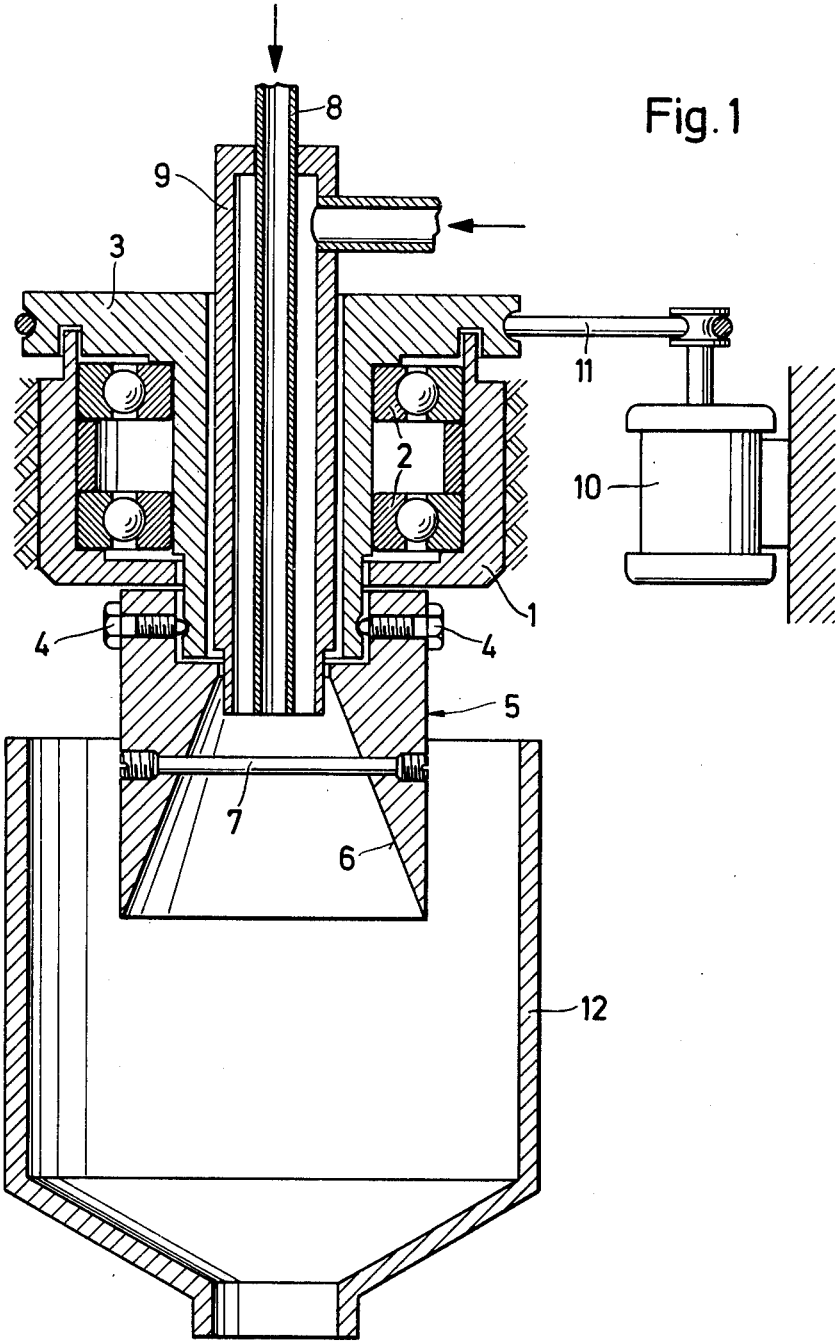
FIG. 1 is a cross-sectional view of a mixing device in accordance with this invention.
Figure 2:
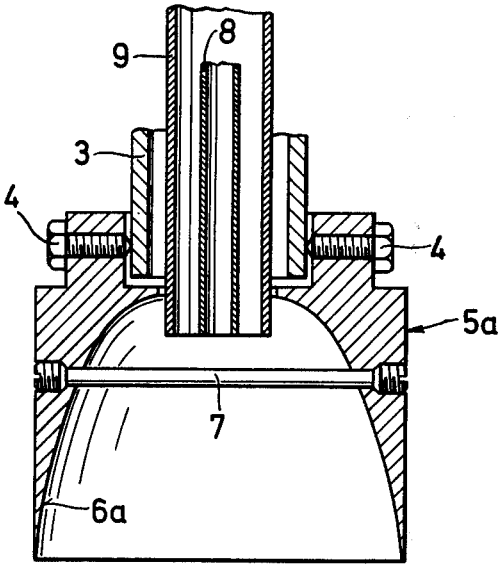
FIGS. 2 to 7 show various forms of rotor for the device shown in FIG. 1.
Figure 3:
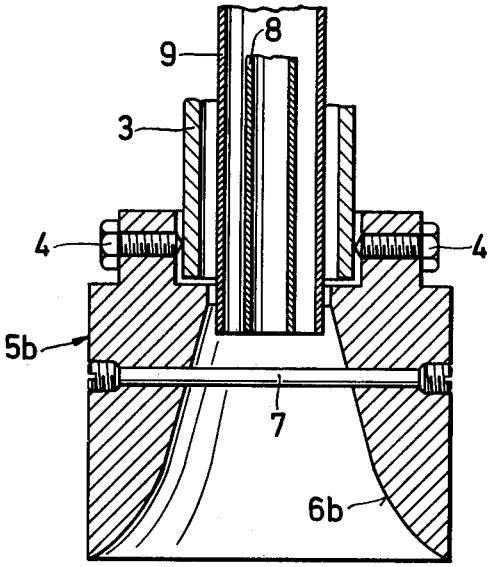
Figure 4:
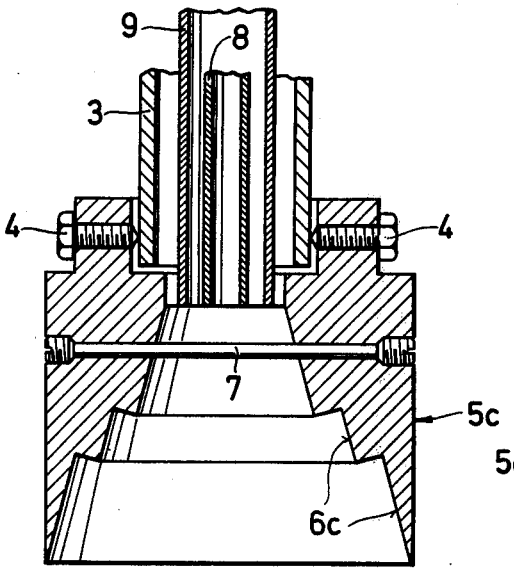
Figure 5:
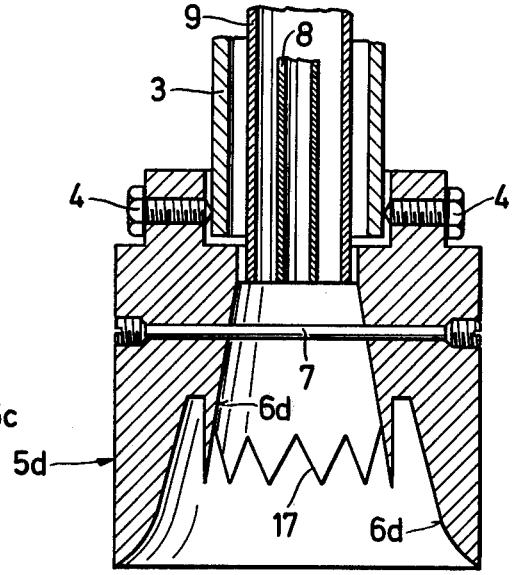
Figure 8:
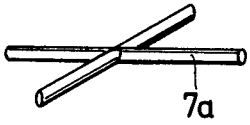
FIGS. 8 to 10 are perspective views of various means for applying the ingredients to the mixing surface of the device shown in FIG. 1.
Figure 9:
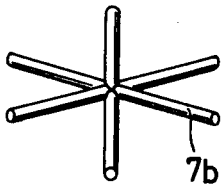
Figure 10:
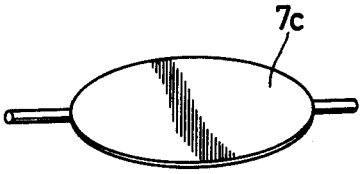

Referring to FIG. 1, a support sleeve 3 is rotatably mounted by two ball bearing races 2 in a mount 1. Secured to the bottom end of sleeve 3 by means of screws 4 is a hollow rotor 5 whose inner wall is conical and defines a mixing surface 6. Extending transversely through rotor 5 is a rod or bar 7 which serves as distributing element. A cross 7*a*, a star 7*b* or a disc 7*c* as shown in FIGS. 8, 9 and 10 respectively can be used instead of the member 7, the only important consideration being that the ingredients which it is required to mix with one another are prevented from dropping straight through.

Disposed within sleeve 3 are two coaxial feed ducts 8, 9 for two ingredients which are to be mixed together, the ducts 8, 9 both terminating in the rotor 5, which is driven by an electric motor 10 and belt 11 engaging a groove in a flange at the upper end of the sleeve 3. Motor 10 and all the other parts of the mixing device can either be disposed in a stationary frame or preferably, combined to form a portable unit.

In operation, the ingredients which are required to be mixed with one another are introduced through ducts 9, 8 into the rotating rotor 5, where they are premixed by the member 7 and then thrown out by centrifugal force to that region of the mixing surface which is near the axis of rotation of the rotor 5. A uniform liquid comprising an intimate mix of the two ingredients is thereby formed on the mixing surface 6. At the bottom edge of the mixing surface the intimately mixed ingredients are thrown off in the form of fine droplets and are collected in a collector 12 or directly in a casting mould. If required, the operation can proceed in a vacuum so as to prevent air bubbles.

FIGS. 2 to 5 show various forms of rotor each of which has a bottom opening. Rotor 5*a* of FIG. 2 has a substantially parabolic mixing surface 6*a*. Mixing surface 6*b* of rotor 5*b* of FIG. 3 has an upper conical portion which merges into a lower convex portion. Mixing surface 6*c* of rotor 5*c* of FIG. 4 comprises three stepped conical portions, and mixing surface 6*d* of rotor 5*d* of FIG. 5 comprises an upper conical portion and a lower convex portion similar to that shown in FIG. 3, bottom edge 17 of the upper portion being serrated.

Figure 6:
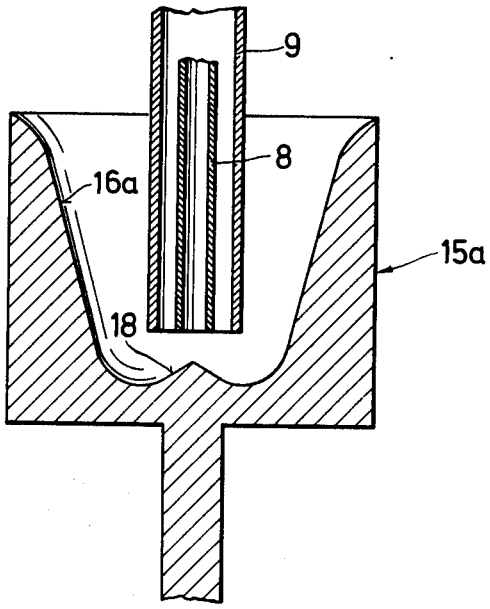
Figure 7:
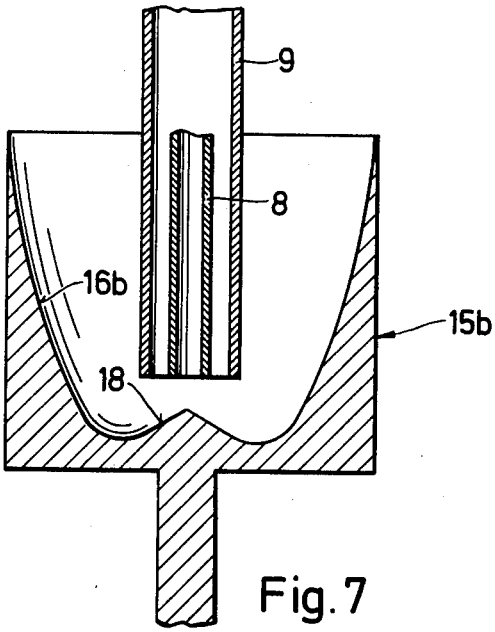

FIGS. 6 and 7 show rotors having mixing surfaces which open upwards. For the sake of simplicity the mounting and drive means for the rotors is not shown, but they can be as shown in FIG. 1.

All the mixing surfaces have at least a portion which is inclined towards the axis of rotation of the rotor.

Rotor 15*a* of FIG. 6 has a mixing surface 16*a* which, except for its convex top edge region, is concave in cross section and has at its centre a conical portion 18. Mixing surface 16*b* of rotor 15*b* of FIG. 7 is similar except for the conical portion 18, to mixing surface 6*a* of FIG. 2. In the embodiments shown in FIGS. 6 and 7 the conical portions 18 perform the same function as the element 7 in FIGS. 1 to 5. In FIGS. 6 and 7 the discrete ingredients are premixed before they reach the actual mixing surface.

Operation of the mixing device having open-top rotors is the same as for the devices having open-bottom rotors. When the device is run fast enough, the two ingredients to be mixed and which are applied to the central portion of the mixing surface from the coaxially aligned ducts 8 and 9 flow downwardly or upwardly as a thin film along the mixing surface and mix intimately with one another. The intimately mixed ingredients are then thrown off the edge of the mixing surface.

The geometric shape of the mixing surface is not particularly critical, but mixing surfaces of the kinds shown in FIGS. 1 to 3, 6 and 7 have proved to be the best in practice. Depending upon the curvature of the mixing surfaces, the thicknesses of the liquid film and therefore the extent of mixing, can be varied within limits. The rotor speed depends upon the viscosity of the ingredients to be mixed together and can vary between something like 500 and 6000 r.p.m. The top limit for viscosity is approximately 15000 cP.

The mixing device described above has a very high throughput, amounting to a maximum of approximately 0.5 liter/cm/minute referred to the diameter of the edge of the mixing surface.

The mixing device is of simple construction; is easy to clean; can operate irrespective of position and deal with a wide range of viscosities; it has a high throughput, and is suitable for dealing with ingredients containing fillers. It is particularly suited to the production of foamed plastics since the air which is trapped in finely-divided form in the plastics ingredients as a result of intensive mixing causes nucleation and therefore more uniform and more intensive foaming.

What is claimed is:

1. A mixing device comprising a hollow rotor having an axis of rotation and an inner wall defining a mixing surface, at least a portion of the wall surface being inclined relative to the rotational axis of the rotor, means adjacent that portion of the mixing surface closest to the axis of rotation to combine two or more ingredients and centrifuge the combined ingredients on to the mixing surface by rotation of said combining means.

2. A device according to claim 1, in which the combining means is a rod, said device including means securing said rod in said rotor perpendicular to the rotational axis thereof.

3. A device according to claim 1, in which the combining means is at least two rods bisecting each other, said device including means securing said rods perpendicular to the rotational axis thereof.

4. A device according to claim 1, in which the combining means is a planar disc said device including means securing said planar disc perpendicular to the rotational axis thereof.

5. A device according to claim 1, in which the combining means comprise a substantially conical convex portion extending from the centre of the mixing surface.

6. A device according to claim 1, wherein the mixing surface is substantially concave.

7. A device according to claim 6, wherein the mixing surface has a convex edge.

* * * * *